US005414217A

United States Patent [19]

Neuroth et al.

[11] Patent Number: 5,414,217

[45] Date of Patent: May 9, 1995

[54] HYDROGEN SULFIDE RESISTANT ESP CABLE

[75] Inventors: David H. Neuroth, Tulsa; Thomson H. Wallace, Claremore, both of Okla.

[73] Assignee: Baker Hughes Incorporated, Houston, Tex.

[21] Appl. No.: 120,016

[22] Filed: Sep. 10, 1993

[51] Int. Cl.[6] ..... H01B 7/00; H01B 7/18

[52] U.S. Cl. ..... 174/120 R; 174/110 FC; 174/120 AR; 174/102 R; 174/110 AR

[58] Field of Search ..... 174/120 R, 110 AR, 120 AR, 174/120 SR, 110 FC, 102 R, 107, 109, 113, 95, 96, 97, 98, 104, 108, 103

[56] References Cited

U.S. PATENT DOCUMENTS

| | | | |
|---|---|---|---|
| 3,030,257 | 4/1962 | Whearley et al. . | |
| 3,041,673 | 7/1962 | Goodwine . | |
| 3,832,481 | 8/1974 | Boyd | 174/102 R |
| 3,889,049 | 6/1975 | Legg et al. . | |
| 4,088,830 | 5/1978 | Wargin et al. . | |
| 4,096,351 | 6/1978 | Wargin et al. . | |
| 4,284,841 | 8/1981 | Tijunelis | 174/103 |
| 4,435,613 | 3/1984 | Gaubert . | |
| 4,472,598 | 9/1984 | Boyd et al. . | |
| 4,515,993 | 5/1985 | MacKenzie | 174/102 R |
| 4,600,805 | 7/1986 | Glynn | 174/102 R |
| 4,611,656 | 9/1986 | Kendall, Jr. et al. . | |
| 4,658,089 | 4/1987 | Guay et al. . | |
| 4,675,474 | 6/1987 | Neuroth . | |
| 4,780,574 | 10/1988 | Neuroth | 174/102 D |

*Primary Examiner*—Leo P. Picard
*Assistant Examiner*—Stephen T. Ryan
*Attorney, Agent, or Firm*—Felsman, Bradley, Gunter & Dillon

[57] ABSTRACT

An electrical cable for a submersible well pump is provided which is resistant to attack by hydrogen sulfide and which is less susceptible to damage from expanding gases during decompression. The electrical cable has a central copper conductor core. The conductor core is surrounded by a layer of electrical insulation material of either thermosetting or thermoplastic material. Surrounding the insulation material is a polymeric, low permeable layer having a hydrogen sulfide permeability rate which is substantially lower than the insulation material. A metal tape layer, such as lead tape, surrounds the low permeable layer. One or more conductor cores together with the insulation, low permeable layer and metal tape layer can be embedded in an elastomeric jacket and provided with an outer metal armor to provide a single electrical cable.

19 Claims, 2 Drawing Sheets

HYDROGEN SULFIDE RESISTANT ESP CABLE

BACKGROUND OF THE INVENTION

1. Field of the Invention

This invention relates to electrical cable for use with submersible pumps used in oil wells, and in particular to electrical cables that are resistant to hydrogen sulfide gas.

2. Description of the Prior Art

This invention concerns electrical submersible pump cables, commonly referred to as ESP cables, used to power downhole electrical motors for submersible pumps in oil wells. Submersible pumps provide an economical method of pumping large volumes of production fluids from wells that are often several thousand feet deep and often under high temperatures and pressures. The production fluids found in these wells will often contain large amounts of dissolved gases such as methane, carbon dioxide and hydrogen sulfide. Electrical cable used to power these pumps must be specifically designed to withstand exposure to these gases and to the damaging effects of decompression which occurs when the pressure within the well is rapidly reduced such as when the submersible pump and electrical cable are pulled to the surface for servicing.

A typical electrical cable for a submersible pump consists of a copper conductor which is surrounded by an insulating material. Several conductors may be used for each cable, each conductor having a layer of insulating material surrounding it. Typically three insulated conductors are used for each cable. The insulated conductors are sheathed in an extruded elastomeric jacket to resist penetration by well fluids with a layer of metal outer armor surrounding the elastomeric jacket.

For most wells the use of electrical cable constructed as above is adequate. However, wells containing hydrogen sulfide gas in sufficient quantities require special considerations. Hydrogen sulfide has been known to permeate the insulation and chemically react with the copper used in the electrical cable to form copper sulfide. Copper sulfide is a non-conductive material that has a lower density than that of metallic copper. When hydrogen sulfide gas permeates the insulation surrounding the copper conductor, the hydrogen sulfide reacts with the copper to form the copper sulfide and causes the conductor to swell. The ability of the conductor to conduct electricity is also reduced because of the copper sulfide.

The conventional method of preventing hydrogen sulfide from permeating the insulation and reacting with the copper conductor is to extrude an impermeable, continuous layer of lead around the insulation to prevent the hydrogen sulfide from penetrating the insulating material. The conventional electrical cable with the lead sheath has many serious drawbacks and limitations however. The lead sheath makes the electrical cable heavy and difficult to handle. It is easily damaged during flexing, with the lead becoming increasingly brittle in colder environments. The lead has a poor fatigue resistance which limits the number of times the electrical cable can be reinstalled in a well. Because the lead sheath must be quite thick, typically 0.040 inches, there is less room for insulation in the cable construction. This often requires the voltage rating to be lowered or causes the insulation to be over-stressed. Repairing and splicing of the lead sheath is difficult and requires a new lead sheath to be placed over the splice and hermetically sealed around each conductor. This is often difficult to achieve with soldering techniques.

One of the major problems associated with conventional electrical cables employing continuous lead sheaths is decompression. The extrusion, handling and splicing eventually creates small holes or cracks along the lead layer so that gases penetrate into the insulation when the cable is introduced into a gas well. Gases will continue to permeate the insulation until the pressure of the dissolved gases in the intermolecular spaces of the insulation and the pressure of the gases in the well fluid reach equilibrium. Decompression occurs when the pressure outside the cable is reduced causing the dissolved gases inside the insulation to expand and escape from the cable until a new, lower pressure equilibrium condition is established.

The two principle sources of decompression occur when a reduction in fluid column height within the well is achieved due to pump activation or when the cable is removed from the well. The rate of pressure change in either case depends on many variables such as reservoir characteristics and pull rates. The rapid reduction in pressure can easily damage the electrical cable insulation. When the pressure is reduced, the dissolved gases tend to expand, just as when the pressure is relieved when opening a soda bottle. If the pressure change is rapid enough, bubbles will form inside the insulation causing microscopic tears in the insulation. In some cases, decompression can be so severe as to cause holes to "blow out" in the insulation rendering the cable useless.

During decompression of conventional lead sheathed cables, gases escaping from the insulation tend to build up beneath the lead layer. Because the gas cannot escape fast enough through the small holes through which the gas entered, the lead sheath often begins to stretch and rupture. This leads to a sudden decompression of the insulation, causing blow outs and other physical and chemical damage.

What is needed is an electrical cable for a submersible well pump which is resistant to hydrogen sulfide gas but that is lighter than conventional lead covered cables, is less likely to fatigue, is easily repaired or spliced, and is less inclined to rupture from internal gas pressure during decompression.

SUMMARY OF THE INVENTION

An improved electrical cable for a submersible well pump is provided which is resistant to hydrogen sulfide gas. The electrical cable has a copper conductor core and a thermoplastic or thermosetting electrical insulation layer surrounding the conductor core. Each insulated conductor core has a polymeric, low permeable layer which surrounds the insulation layer in the preferred embodiment. The low permeable layer may be formed from a fluorocarbon polymer and has a hydrogen sulfide permeability rate which is lower than that of the insulating layer. A metal tape layer, usually lead, preferably surrounds the low permeable layer.

Several insulated conductors constructed with the low permeable layer and the metal tape may be used in one cable with an electomeric jacket surrounding the metal tape of each of the conductors. An outer metal armor is provided to encase the elastomeric jacket.

DETAILED DESCRIPTION OF THE INVENTION

Figure 1:
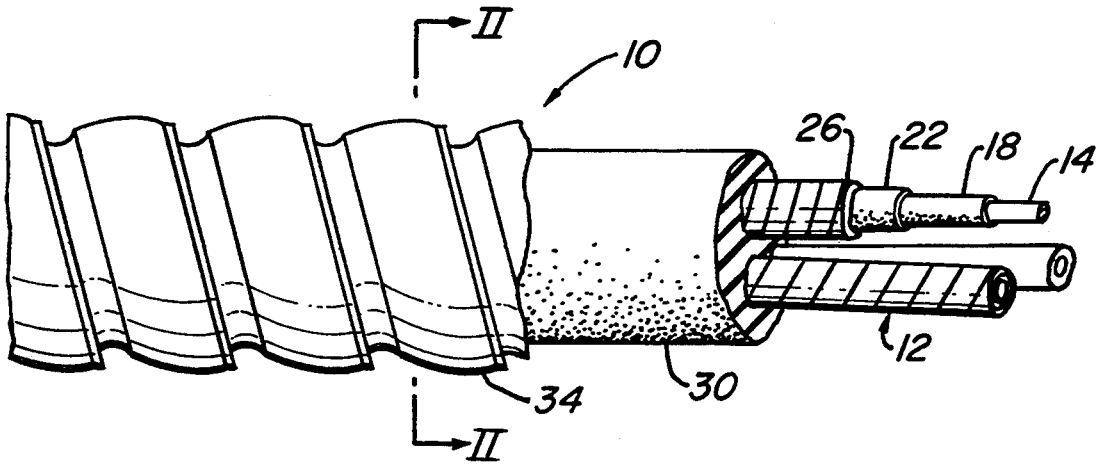
FIG. 1 is a side view of the electrical cable constructed in accordance with this invention.
Figure 2:
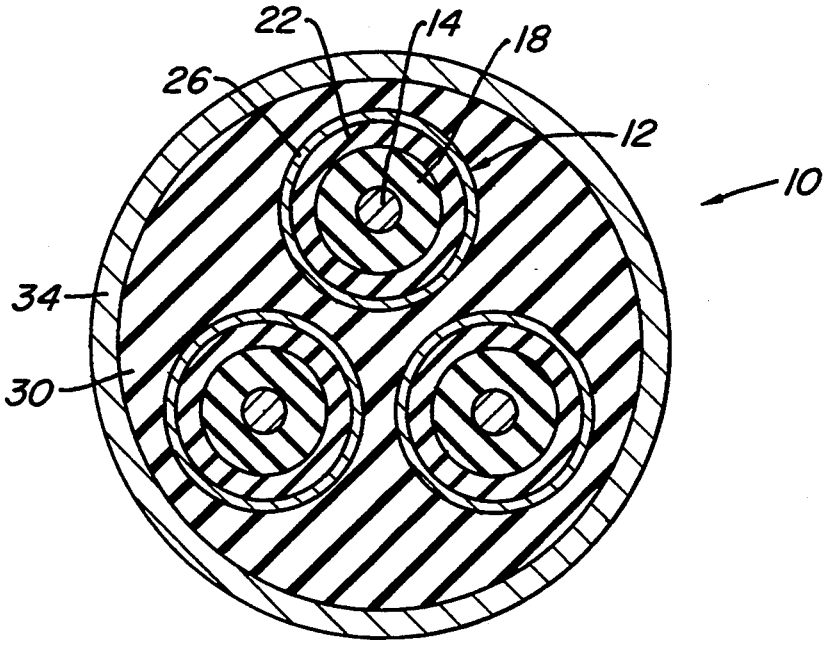
FIG. 2 is a cross-sectional view of the electrical cable of FIG. 1 taken along the lines II—II.

Referring to the drawings, FIGS. 1 through 4 disclose the electrical cable and conductor of the invention. As can be seen in FIGS. 1 and 2, an electrical cable 10 is provided with three insulated conductors 12. Each of the insulated conductors 12 is constructed in the same manner and one is shown enlarged in FIGS. 3 and 4. The insulated conductors 12 each have a central, copper conductor core 14. The conductor core 14 may be a single, solid copper wire or may be formed from several strands of copper wire.

Surrounding the conductor core 14 is a layer of electrical insulation material 18. The insulation material 18 may be either a thermoplastic material or a thermosetting material. Typical thermoplastic materials used are polypropylene and polyethylene. Typical thermosetting insulators include EPDM (ethylene-propylene-diene monomer terpolymer), crosslinked polyethylene and silicone rubber. The thickness of the electrical insulation layer 18 is preferably in the range of 0.075 to 0.090 inches. The insulation layer 18 should be oil and brine resistant but should be permeable to low molecular weight gases. The physical and electrical properties of the insulation layer 18 should remain essentially unaffected by the absorption of very low molecular weight hydrocarbons such as methane under high pressure. Typically the thermoplastic materials used for the insulation layer 18 are structurally stronger than those thermosetting materials used and are therefore less easily damaged during decompression. The insulation material 18 may be extruded onto the conductor core 14 and cured in place to provide an insulation layer resistant to attack by water and well fluids.

In the preferred embodiment, a low permeable layer 22 surrounds the insulation layer 18. The low permeable layer 22 is formed from a thermoplastic polymer which has a permeability to hydrogen sulfide which is substantially lower than the electrical insulation material 18. Materials which are most suited for this application include fluorcarbon polymers such as polyvinylidene fluoride, fluorinated ethylene propylene, perfluoroalkoxy (resin), and polytetraflourethylene. Engineered thermoplastics such as polyetheretherketone (PEEK) and polyetherimide, also known as ULTEM, available from General Electric Company, Polymers Product Dept., Pittsfield, Mass. 01201, may also be used. These materials may be either homopolymers, copolymers or a combination of these specialized materials. The thickness of the low permeable layer 22 is preferably about 0.004 to 0.010 inches thick, however, the thickness may vary.

Although many different types of materials may be used for the low permeable layer 22, the essential characteristic of the low permeable layer 22 is that the hydrogen sulfide permeability rate must be substantially lower than that of the insulation layer 18. If the insulation material is a thermoplastic material, the hydrogen sulfide permeability rate of the low permeable layer 22 must be at least three times lower than the insulation. If the insulation material is a thermosetting material, the permeability rate of the low permeable layer must be at least ten times lower than the insulation. The difference is due to the fact that the thermoplastic insulations are typically stronger than the thermosetting materials and therefore have a better ability to withstand stresses during decompression.

The low permeable layer 22 is extruded over the insulation layer 18 by conventional extrusion methods. Alternatively, the low permeable layer 22 may be formed as a tape which is wrapped around the insulation 18 and heated so that the tape is fused together.

Figure 3:
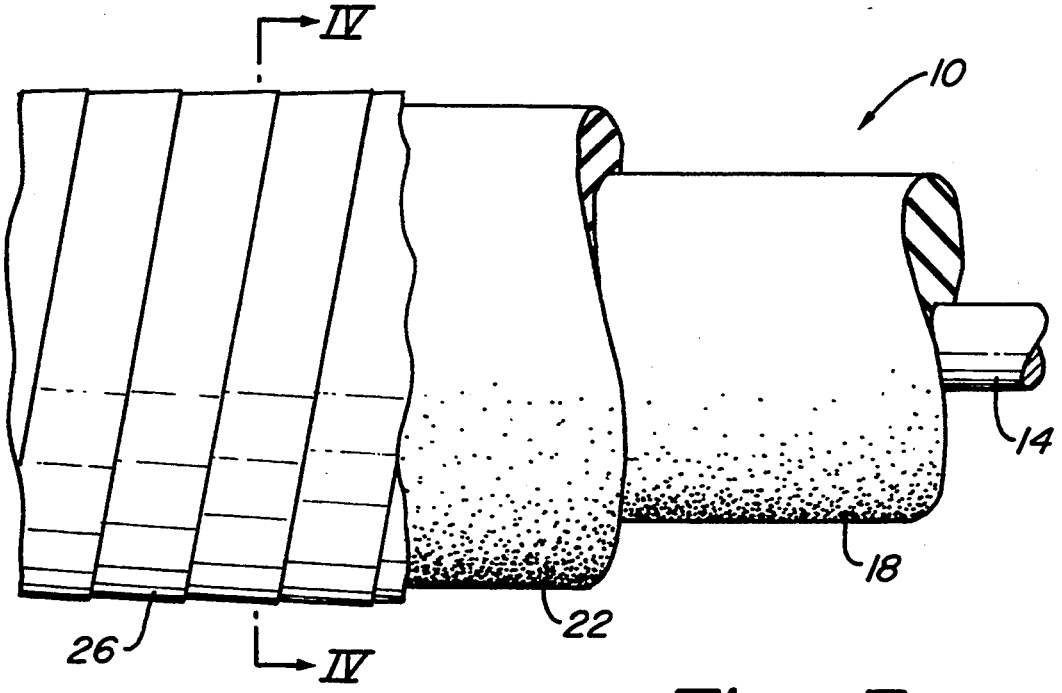
FIG. 3 is a side view of an insulated conductor constructed in accordance with the invention.
Figure 4:
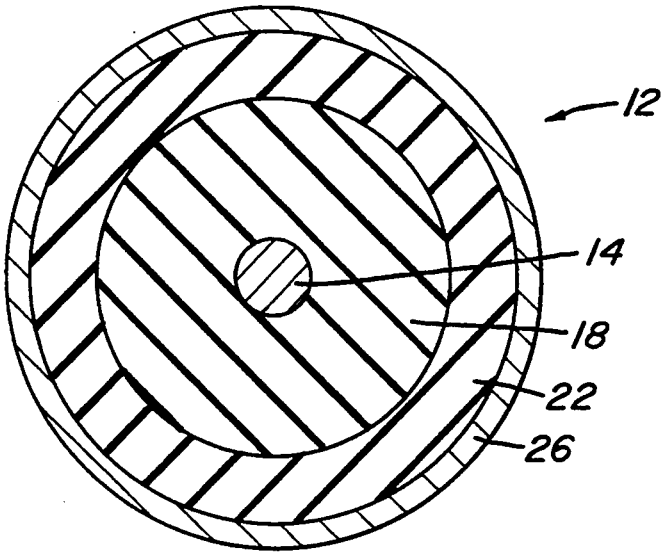
FIG. 4 is a cross-sectional view of the insulated conductor of FIG. 3 taken along the lines IV—IV.

Referring to FIG. 3, a metal tape layer 26 is wrapped helically around the low permeable layer 22. The metal tape layer 26 is preferably lead but may be formed from other corrosion resistant metals such as stainless steel or monel. The metal tape is typically 0.001 to 0.005 inches thick and may be wrapped around the low permeable layer as a single or multiple layer. A single layer of metal tape is typically overlapped between 10% to 50%. Double layers may be overlapped between 5% and 30%.

The metal tape 26 may also be bonded to a thermoplastic substrate or carrier, such as polyethylene. This would be wrapped around the low permeable layer 22 and then heated after assembly so that the thermoplastic substrate is fused together.

As can be seen in FIGS. 1 and 2, each hydrogen sulfide resistant insulated conductor 12 is embedded in an elastomeric jacket 30. The three insulated conductors 12 are oriented so that the center point of each conductor is radially spaced apart 120 degrees about the longitudinal axis of the cable 10. The elastomeric jacket 30 is extruded over and bonded to the metal tape layer 26 of the insulated conductors 12. The material for the jacket 30 may be any type of polymer, rubber or plastic suitable for downhole applications. This material should resist attack or deterioration by chemical agents, including salts, acids, gases and hydrocarbons present in the well.

An outer metal armor 34 comprised of steel strips which are wrapped around the elastomeric jacket 30 protects and strengthens the cable 10.

The combination of the low permeable layer 22 and the metal tape layer 26 protects the underlying insulation 18 from decompression damage and the copper conductor 14 from significant hydrogen sulfide attack. In order to understand the invention and how it works it is important to understand what occurs once the electrical cable 10 is installed in an oil well.

Hydrogen sulfide may represent only a small fraction of all the gases present in an oil well. The fraction is usually expressed in parts per million (ppm) of all the gases in the production fluid. The fraction of hydrogen sulfide present rarely exceeds 200,000 ppm. More commonly, the fraction of hydrogen sulfide is less than 50,000 ppm or 5% of all the gases present in the production fluid.

When an electrical cable is first installed in an oil well, the insulation will not contain any dissolved gases. The intermolecular spaces within the insulation will thus not be filled with any pressurized gas molecules. Due to the height of the production fluid column within the well, the pressure will be very high within the fluid column. This high pressure will readily force gases through the interstices of the overlapped portions of the metal tape 26 and then gradually through the low permeability layer 22 and on into the insulation 18. In a very short time, typically less than 24 hours, the insulation 18 will be saturated with the same gases that are in the solution of the oil well production fluids. It should be noted that the relative concentration of the gases, one to another, in the insulation 18 of the electrical cable may be somewhat different than in the production fluids due to differing permeability rates of different gases through the low permeability layer. These differences do not detract, however, from the basic principles taught in this invention.

It is important to recognize that the initial movement of gases into the insulation 18 is driven by the tremendous differences in pressure between the fluid outside the cable and the empty spaces between the molecules inside the insulation. For exemplary purposes, assume that the individual permeability rates for each gas are uniform throughout the insulation system, and that the amount of hydrogen sulfide gas present in the production fluids and which eventually permeates the insulation 18 is 5% or 50,000 ppm. If all the hydrogen sulfide within the insulation 18 reacts with the copper in the conductor core 14 and is replaced by an equal volume of gas mixture from the production fluid, the amount of hydrogen sulfide gas as a fraction of all the gases dissolved in the insulation 18 amounts to only 2,500 ppm. If this amount of hydrogen sulfide in the insulation 18 also reacts with the copper of the conductor core 14 and is replaced with more of the gases from the well fluids, the net concentration of hydrogen sulfide in the insulation 18 will be 125 ppm. As pressure equilibrium between the gases in the intermolecular spaces within the insulation and the well fluids is achieved, this process repeats itself until the amount of hydrogen sulfide present in the insulation becomes insignificant, eventually approaching zero.

Once pressure equilibrium has been established, the only driving mechanism to force more hydrogen sulfide into the insulation system is the difference in partial pressures due to the greater concentration of hydrogen sulfide in the well fluids than in the insulation 18. Partial pressure differences are very weak driving mechanisms to encourage further hydrogen sulfide gas permeation as compared to those occurring during initial exposure. Unlike pressure driven mass transfer, the rate of partial pressure driven permeation is directly proportional to the exposed area between the fluids and the insulation 18. The presence of the low permeability layer 22 directly below the metal tape 26 greatly slows down this gas diffusion process.

The exposed area in the interstices of the overlapped metal tape layer 26 is extremely small. This combined with the low permeable layer 22 directly under the metal tape is sufficient to halt the migration of hydrogen sulfide through the insulation 18 to the surface of the copper conductor core 14. The need for a continuous metal sheath surrounding the insulation is thus obviated. The amount of copper sulfide produced from the reaction of the hydrogen sulfide which does reach the copper of the conductor core 14 is sufficiently small to avoid any significant swelling or reduction in conductivity.

When the insulation 18 becomes saturated with dissolved gases as pressure equilibrium is established another problem is presented. When the pressure on the electrical cable 10 is reduced, such as when the pump is activated or the cable is removed from the well, the dissolved gases will tend to expand. The more rapidly the pressure changes, the greater the expansion of the dissolved gases which could cause extensive damage to the insulation. If the pressure changes rapidly enough, bubbles will form in the insulation to cause microscopic tears in the molecular chain structure of the insulation. The amount of damage to the insulation by decompression is dependent on the rate at which the gases try to escape. The rate at which gases escape is dependent on the pressure gradient across the insulation system. If the pressure gradient across the insulation is low, the gases will merely migrate through the insulation to the outer surface and out the insulation layer. If the gradient is too high, the gases will expand too rapidly and form bubbles within the insulation, causing tiny rips and tears as the expanding gases exit the insulation.

The construction of the insulated conductors 12 in the electrical cable 10 helps prevent the insulation damage described above. This is accomplished by the presence of the low permeable layer 22. When the outside pressure is suddenly dropped, the gases start to escape from the insulation 18. The gases are prevented from rapidly leaving the insulation layer 18, however, by the low permeable layer 22. The low permeable layer 22 creates a large pressure gradient across its thickness, which causes the pressure gradient across the insulation layer 18 to be lower. The gases will eventually migrate through the low permeable layer 22 and out the interstices of the metal tape 26 so that a new pressure equilibrium is established. The presence of the low permeable layer 22 allows the migration of the gases to occur over an extended period so that the insulation is not damaged.

There are several advantages of the electrical cable of the invention over the prior art. Cables made according to this invention are lighter than conventional lead covered cables because the metal tape allows a thinner layer of metal to be used. This reduction in weight makes the cable easier to handle, less subject to damage and it can be made into longer lengths than conventional lead cables. The thin metallic layer is less subject to metal fatigue and even if small cracks are formed in the metal tape layer, the cable is not adversely affected.

The electrical cable of this invention provides greater protection from decompression damage to the insulation than does the conventional lead cable. The low permeable layer provides a large pressure gradient so that the pressure at the surface of the insulating layer is low enough to prevent gases from expanding too quickly thereby creating blow outs or otherwise damaging the insulation. The metal tape layer will not rupture due to a build up of internal gas pressure. The gas is allowed to escape through the interstices where the metal tape overlaps.

While the invention has been shown in only one of its forms, it should be apparent to those skilled in the art that it is not so limited, but is susceptible to various changes without departing from the scope of the invention.

We claim:

1. An electrical cable for use in oil and gas wells containing hydrogen sulfide gas, comprising in combination:

a copper conductor core;

an electrical insulation layer surrounding the conductor core;

a first layer surrounding the insulation;

a second layer surrounding the first layer, one of the first and second layers being a polymeric, low permeable layer having a hydrogen sulfide permeability rate which is substantially lower than that of the insulation layer, and the other of the first and second layers being a metallic tape layer; and an outer armor layer surrounding the second layer.

2. The electrical cable of claim 1, wherein:

the first layer is the low permeable layer; and the second layer is the metallic tape layer.

3. The electrical cable of claim 1, wherein:

the low permeable layer is a fluorocarbon polymer.

4. The electrical cable of claim 1, further comprising:

an elastomeric jacket surrounding the second layer; and wherein the outer armor layer surrounds the elastomeric jacket.

5. The electrical cable of claim 1, wherein:

the metallic tape layer is formed from lead.

6. An electrical cable for use in oil and gas wells containing hydrogen sulfide gas, comprising in combination:

a copper conductor core;

an electrical insulation layer surrounding the conductor core;

a polymeric, low permeable layer surrounding the insulation layer, the low permeable layer having a hydrogen sulfide permeability rate which is substantially lower than that of the insulation layer;

a metal tape layer of corrosion resistant metal surrounding the low permeable layer; and an outer metal armor layer surrounding the metal tape layer.

7. The electrical cable of claim 6, wherein:

the low permeable layer is formed from an extruded fluorocarbon polymer.

8. The electrical cable of claim 6, wherein:

the metal tape layer is formed from lead.

9. The electrical cable of claim 6, wherein:

the low permeable layer is formed by wrapping a fluorocarbon polymer tape around the insulation layer and heating the fluorocarbon polymer tape so that the fluorocarbon polymer tape is fused together.

10. The electrical cable of claim 6, further comprising:

an elastomeric jacket surrounding the metal tape layer; and wherein the outer metal armor layer surrounds the elastomeric jacket.

11. An electrical cable for use in oil and gas wells containing hydrogen sulfide gas, comprising in combination:

a copper conductor core;

an electrical insulation layer surrounding the conductor core;

a low permeable layer of a fluorocarbon polymer surrounding the insulation layer, the low permeable layer having a hydrogen sulfide permeability rate which is substantially lower than that of the insulation layer;

a lead tape layer surrounding the low permeable layer, the lead tape layer having interstices to allow passage of gas therethrough;

an elastomeric jacket surrounding the lead tape layer; and an outer metal armor layer surrounding the elastomeric jacket.

12. The electrical cable of claim 11, wherein:

the insulation layer is a thermoplastic material.

13. The electrical cable of claim 11, wherein:

the insulation layer is a thermosetting material.

14. The electrical cable of claim 11, wherein:

the low permeable layer is formed by wrapping fluorocarbon polymer tape around the insulation layer and heating the tape so that the tape is fused together.

15. A method of forming an electrical cable for use in oil and gas wells containing hydrogen sulfide gas, the method comprising the steps of:

providing a copper conductor core;

surrounding the copper conductor core with electrical insulation material;

surrounding the insulation material with a first layer;

surrounding the first layer with a second layer, one of the layers being a polymeric, low permeable layer having a hydrogen sulfide permeability rate which is substantially lower than that of the insulation layer, and the other of the layers being a metallic tape layer having interstices to allow passage of gas therethrough; and surrounding the second layer with an outer armor layer.

16. The method of claim 15, wherein:

the first layer is the low permeable layer; and the second layer is the metallic tape layer.

17. The method of claim 15, wherein:

the low permeable layer is a fluorocarbon polymer.

18. The method of claim 16, wherein:

the step of surrounding the insulation material includes wrapping a polymeric, low permeable tape around the insulation layer and heating the tape so that the tape is fused together.

19. The method of claim 15, wherein:

the step of surrounding the second layer with an outer armor layer includes providing an elastomeric jacket over the second layer; and surrounding the elastomeric jacket with the outer armor layer.

* * * * *